US006691378B1

(12) United States Patent
Chou

(10) Patent No.: US 6,691,378 B1
(45) Date of Patent: Feb. 17, 2004

(54) BUCKLE DEVICE FOR A PAIR OF SWIMMING/DIVING GOGGLES

(76) Inventor: Terry Chou, No. 12, Hsin Ho Herng Rd., Tainan City (TW)

( * ) Notice: Subject to any disclaimer, the term of this patent is extended or adjusted under 35 U.S.C. 154(b) by 0 days.

(21) Appl. No.: 10/420,404

(22) Filed: Apr. 22, 2003

(51) Int. Cl.[7] ..... A44B 11/25; A44B 21/00; G02C 3/00

(52) U.S. Cl. ..... 24/170; 24/3.3; 24/3.13; 24/163 R; 24/265 BC; 24/265 CD; 2/428; 2/452; 248/231.5; 248/902; 351/112; 351/157

(58) Field of Search ..... 24/170, 3.3, 265 BC, 24/265 CD, 3.1, 3.13, 163 R; 2/428, 452; 248/231.5, 902; 351/112, 156, 157

(56) References Cited

U.S. PATENT DOCUMENTS 513,068 A * 1/1894 Anderson ..... 24/265 BC
5,181,280 A * 1/1993 Zachry, Jr. ..... 24/170
5,377,386 A * 1/1995 Griffith ..... 24/3.1
5,459,882 A * 10/1995 Yamamoto ..... 2/428
5,774,953 A * 7/1998 Mao ..... 24/170
5,918,351 A * 7/1999 Chou ..... 24/3.3
6,460,196 B2 * 10/2002 Tsubooka et al. ..... 2/428

* cited by examiner

*Primary Examiner*—Victor Sakran
(74) *Attorney, Agent, or Firm*—Charles E. Baxley

(57) ABSTRACT

A buckle includes a body having a pressing portion, a clamping portion, and a bendable connecting portion between the pressing portion and the clamping portion. The pressing portion includes two sidewalls and a post fixed between the sidewalls. The clamping portion includes a clamping hole. The connecting portion is mounted around a mounting peg of a main body of a pair of swimming/diving goggles. An end of a head strap of the pair of swimming/diving goggles extends into the body, winds around the post, and extends out of the body. The end of the head strap is pullable to obtain a desired tightness, exerting a force to the post to press against retaining edges on two lateral sides delimiting the clamping hole, thereby reliably positioning the head strap in place. The pressing portion is manually movable to disengage the post from the retaining edges, allowing loosening of the head strap.

7 Claims, 17 Drawing Sheets

BUCKLE DEVICE FOR A PAIR OF SWIMMING/DIVING GOGGLES

BACKGROUND OF THE INVENTION

1. Field of the Invention

The present invention relates to a buckle device for a pair of swimming/diving goggles. In particular, the present invention relates to a buckle device for a pair of swimming/diving goggles that allows easy adjustment a head strap of the pair of swimming/diving goggles and that provides a reliable clamping effect for the head strap.

2. Description of the Related Art

FIG. 11 illustrates a conventional buckle for swimming/diving goggles, and FIG. 12 illustrates a pair of swimming/diving goggles using the buckle in FIG. 11. The buckle 1' is made of rigid material and includes a connecting portion 11' on an end thereof for connecting with a pair of swimming/diving goggles. A tying portion 12' is provided on the other end of the buckle 1' for connecting with an end of a head strap 2' made of a soft material. The tying portion 12' is hollow and includes two posts 121' and 122' and a notch 123' in an outer end thereof. As illustrated in FIG. 12, the end of the head strap 2' is wound around the posts 121' and 122' and finally inserted into a space between the notch 23' and the post 121', thereby fixing the tightening length of the head strap 2'.

When adjusting the tightening length of the head strap 2', the user has to remove the pair of swimming/diving goggles from his/her head, loosen the head strap 2' at the posts 121' and 122' and the notch 123', adjust the head strap 2', and then put the pair of swimming/diving goggles back on his/her head. If the tightness of the head strap 2' is not appropriate, the whole adjusting procedure has to be repeated again and again until an appropriate tightness for the user is reached. Further, the head strap 2' is apt to bend and deform due to double winding through the posts 121' and 122'.

FIG. 13 illustrates another conventional buckle, and FIG. 14 illustrates a pair of swimming/diving goggles using the buckle in FIG. 13. The buckle includes a first buckle member 4' and a second buckle member 5'. The first buckle member 4' includes an engaging portion 41' on an end thereof and a clamping portion 42' on the other end thereof. Further, the first buckle member 4' includes coupling elements 411' and 421' on two lateral sides thereof, with a compartment 422' being defined between the lateral sides of the first buckle member 4'. An opening 423' is defined in a front end of the compartment 422', allowing the head strap 6' to extend through the opening 423'. Two retaining pieces 424' are formed on a bottom wall delimiting the compartment 422'.

The second buckle member 5' includes an engaging portion 51' on an end thereof and a clamping portion 52' on the other end thereof. A flexible portion 53' is provided between the engaging portion 51' and the clamping portion 52'. Each of the engaging portion 51' and the clamping portion 52' includes two engaging slots 511', 521' for engaging with the coupling elements 411', 421' of the first buckle member 4'. The clamping portion 52' is hollow and includes a post 522' and a retaining piece 524'.

In assembly, the coupling elements 411', 421' of the first buckle member 4' are engaged with the engaging slots 511', 521' of the second buckle member 5', with the retaining pieces 424' of the first buckle member 4' and the retaining piece 524' pressing against the head strap 6' that is wound through the flexible portion 53' in a manner shown in FIG. 14. The head strap 6' is thus positioned. Nevertheless, when adjustment of the tightening length of the head strap 6' is required, the flexible portion 53' of the second buckle member 5' must be bent before proceeding with the adjustment, which could cause break of the flexible portion 53' after the buckle has been used for a period of time. Further, the engagement between the coupling elements 411', 421' of the first buckle member 4' and the engaging slots 511', 521' of the second buckle member 5' is not reliable. In particular, the head strap 6' would impart an outward force to the second buckle member 5' at "a" (FIG. 14) and thus cause disengagement of the second buckle member 5' from the first buckle member 4'. Further, the user has to remove the pair of swimming/diving goggles from his/her head before proceeding with adjustment of the head strap 6', and repeated adjustments often occur.

FIG. 15 illustrates a further conventional buckle, FIG. 16 illustrates a pair of swimming/diving goggles using the buckle in FIG. 15, and FIG. 17 illustrates adjustment of a head strap of the pair of swimming/diving goggles in FIG. 16. The buckle is made of a bendable material and includes a body 7' having an engaging portion 71' on an end thereof and a clamping portion 73' on the other end thereof. The engaging portion 71' tapers forward and has a slant 711' and a slot 722'. A clamping hole 731' is defined in the clamping portion 73'.

In assembly, the head strap 8' is passed through the clamping hole 731' and the slot 722', and the body 7' is bent, as shown in FIG. 16. After adjustment, as illustrated in FIG. 17, the head strap 8' is pulled toward the clamping hole 731', urging the engaging portion 71' to be tightly inserted into the clamping hole 731' with the aid of the slant 711' . The head strap 8' is positioned due to tight engagement between the engaging portion 71' and the clamping hole 731', thereby fixing the length of the head strap 8'. Nevertheless, the user still has to remove the pair of swimming/diving goggles and disengage the engaging portion 71' from the clamping hole 731' before proceeding with adjustment of the head strap 8', and repeated adjustments often occur.

SUMMARY OF THE INVENTION

An object of the present invention is to provide a buckle that allows easy adjustment of a head strap of a pair of swimming/diving goggles. The buckle includes a body made of a slightly flexible material. The body includes a pressing portion on a first end thereof, a clamping portion on a second end thereof, and a bendable connecting portion between the pressing portion and the clamping portion.

The pressing portion includes two sidewalls and a post fixed between the sidewalls. The clamping portion includes a clamping hole delimited by a bottom wall, two lateral walls, and a top wall extending portions of the lateral walls. A retaining edge is formed on a top edge of each lateral wall.

The connecting portion is mounted around a mounting peg of a main body of the pair of swimming/diving goggles, with the clamping portion and the pressing portion lying side by side. An end of a head strap of the pair of swimming/diving goggles extends into the body via the clamping hole, winds around the post, and extends out of the body via the clamping hole. The end of the head strap is pullable to obtain a desired tightness, exerting a force to the post to press against the retaining edges, thereby reliably positioning the head strap in place.

The pressing portion is manually movable to disengage the post from the retaining edges, allowing loosening of the head strap. Other objects, advantages, and novel features of the invention will become more apparent from the following detailed description when taken in conjunction with the accompanying drawings.

DETAILED DESCRIPTION OF THE PREFERRED EMBODIMENTS

Figure 1:
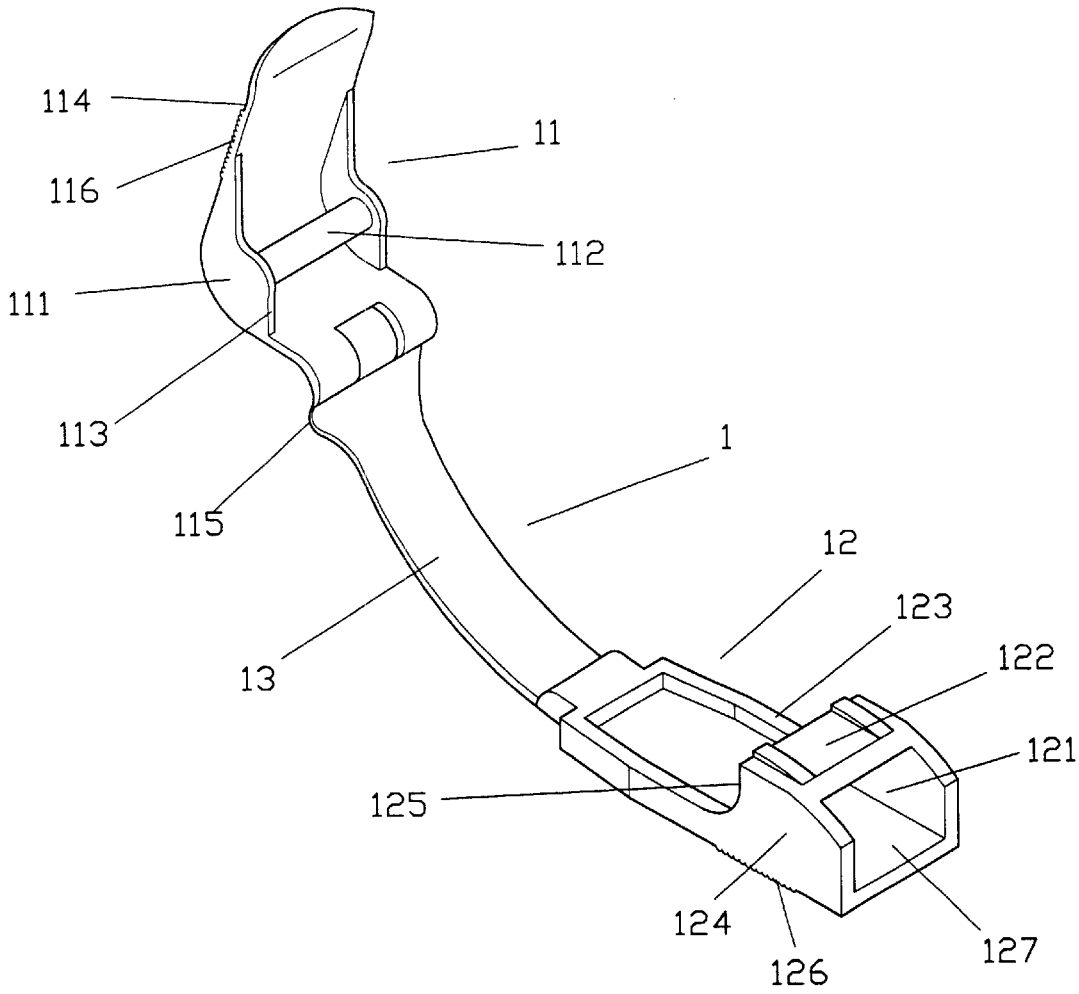
FIG. 1 is a perspective view of a buckle device for a pair of swimming/diving goggles in accordance with the present invention.
Figure 2:
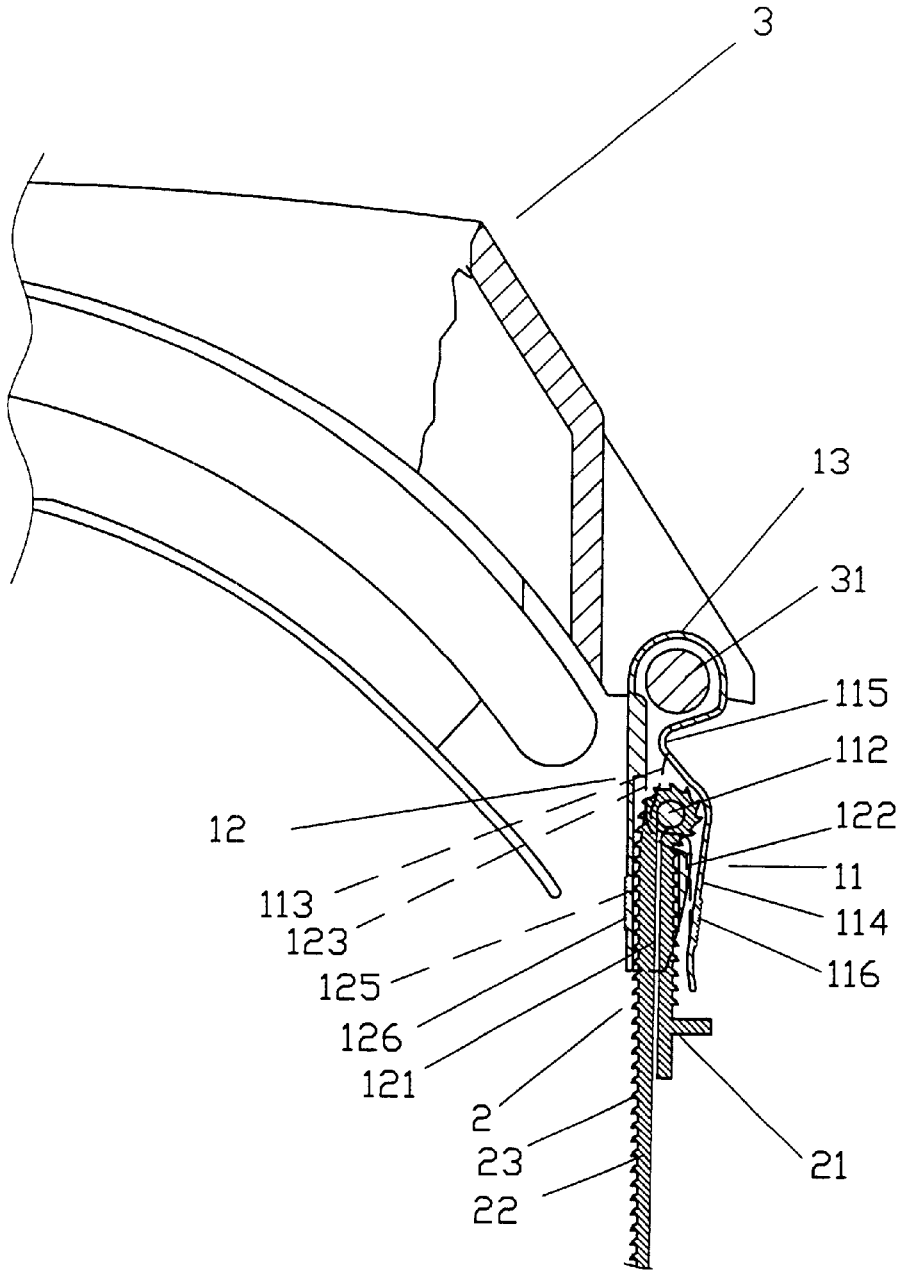
FIG. 2 is a partial top view, partly sectioned, of a pair of swimming/diving goggles using the buckle device in accordance with the present invention.
Figure 3:
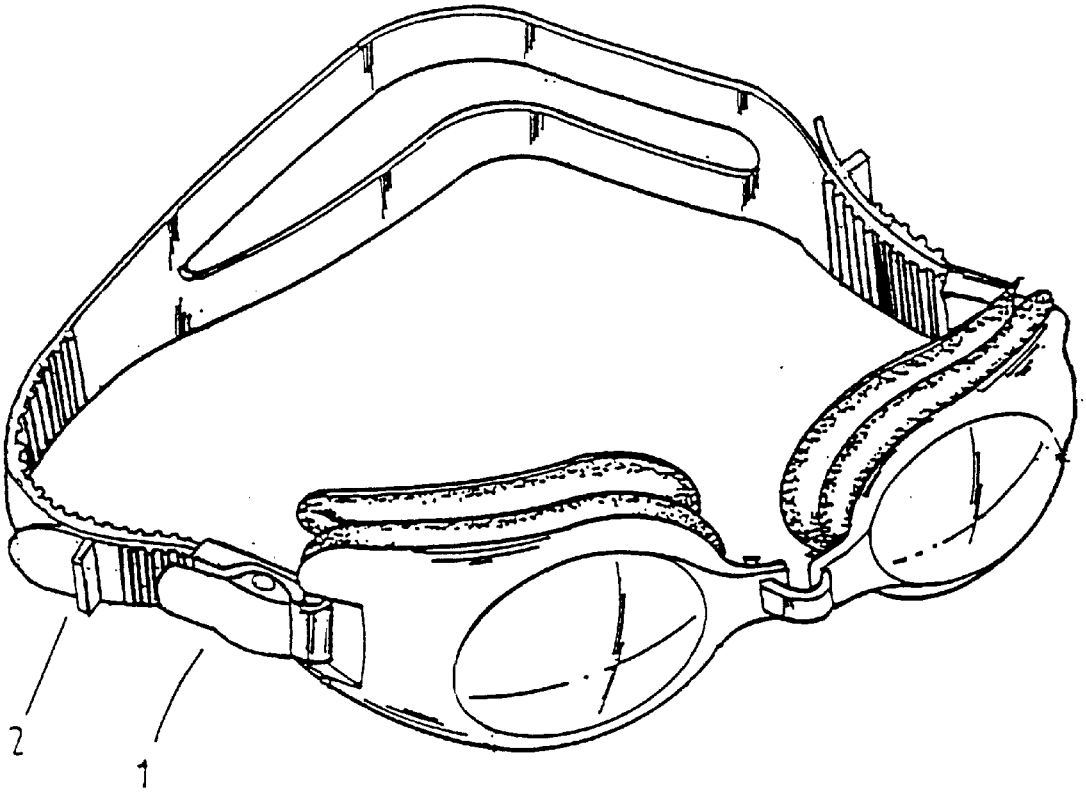
FIG. 3 is a perspective view of the pair of swimming/diving goggles in FIG. 2.

Referring to FIGS. 1 through 3, a buckle device in accordance with the present invention is made of a slightly flexible material and generally comprises a body 1 having a pressing portion 11 on an end thereof and a clamping portion 12 on the other end thereof. The pressing portion 11 and the clamping portion 12 are connected together by a connecting portion 13 that is thinner and bendable.

The pressing portion 11 includes two sidewalls 111 and a post 112 fixed between the sidewalls 111. Each sidewall 111 has a pressing section 113 against which the clamping portion 12 presses. The pressing portion 11 further includes a release section 114 extending from an end thereof, allowing manual operation for adjustment of a head strap 2. Preferably, an anti-slide section 116 is provided on an outer side of the pressing portion 11. Further, a bend 115 extends from the other end of the pressing portion 11.

The clamping portion 12 includes a bottom wall 127, two lateral walls 124 projecting from two sides of the bottom wall 127, and a top wall 122 extending between portions of the lateral walls 124. A clamping hole 121 is defined between the bottom wall 127, the portions of the lateral walls 124, and the top wall 122. The portion of each lateral wall 124 delimiting the clamping hole 121 is has an abutting section 125 against which the respective pressing section 113 presses. Further, a retaining edge 123 is formed on a top edge of each lateral wall 124 and located adjacent to the respective abutting section 125 for retaining the head strap 2 in place. Further, an anti-slide section 126 is provided on an outer side of the clamping portion 12.

Figure 4:
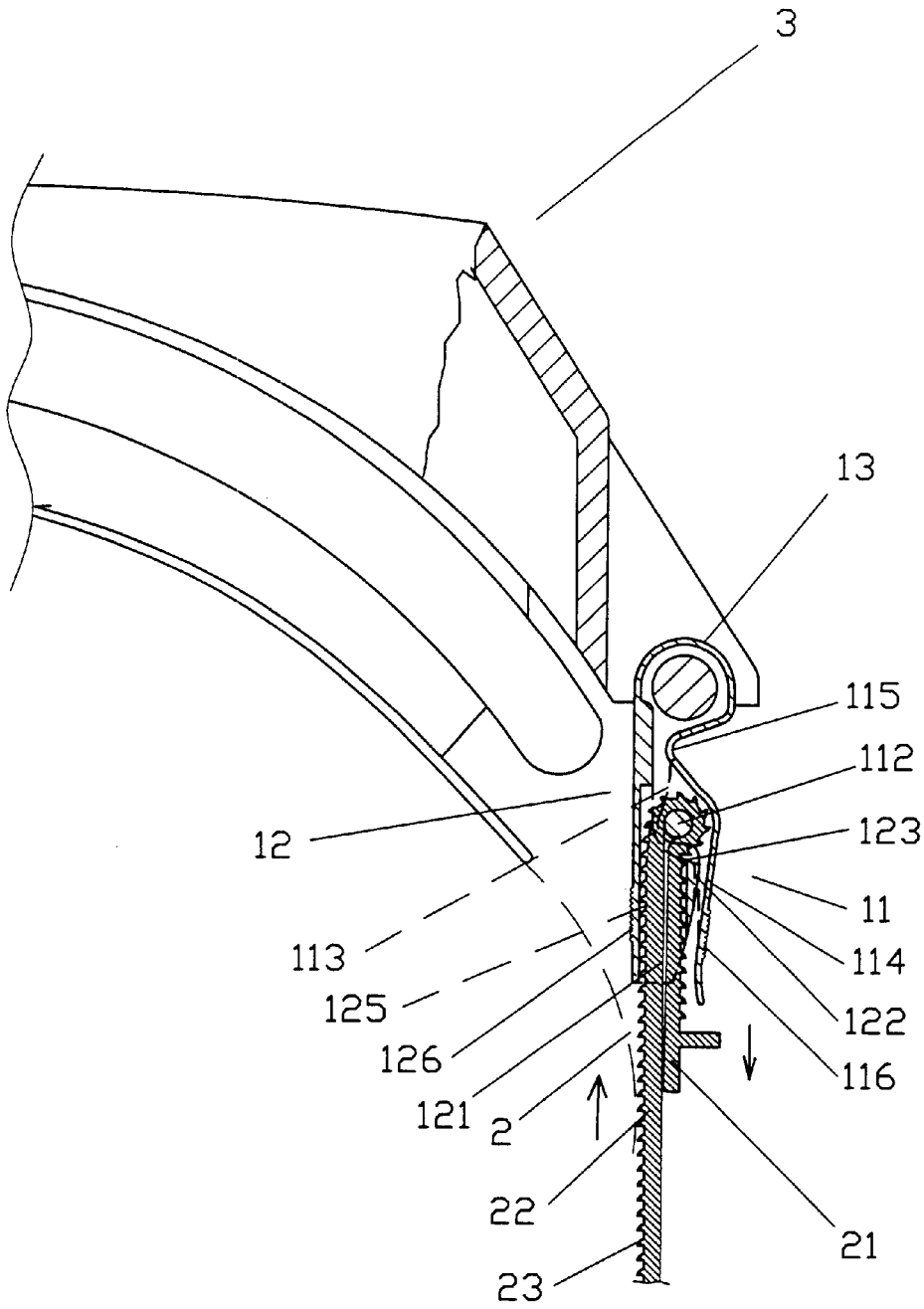
FIG. 4 is a view similar to FIG. 2, illustrating adjustment of tightness of a head strap of the pair of swimming/diving goggles.

In assembly, the connecting portion 13 is wound around a mounting peg 31 of a main body 3 of a pair of swimming/diving goggles, with the pressing portion 11 being located on an outer side of the main body 3. An end of the head strap 2 is extended into the body 1 via the clamping hole 121, wound around the post 112, and then extended out of the body I via the clamping hole 121, as shown in FIG. 2. When adjustment of the head strap 2 is required, as illustrated in FIG. 4, the main body 3 remains on the head of the user, and the user may directly pulls the distal end 21 of the head strap 2 that is located outside. The distal end 21 of the head strap 2 is pulled until the required tightness and length of the head strap 2 are obtained. It is noted that the retaining edges 123 and the post 112 have a gap therebetween, allowing movement of the head strap 2.

Figure 5:
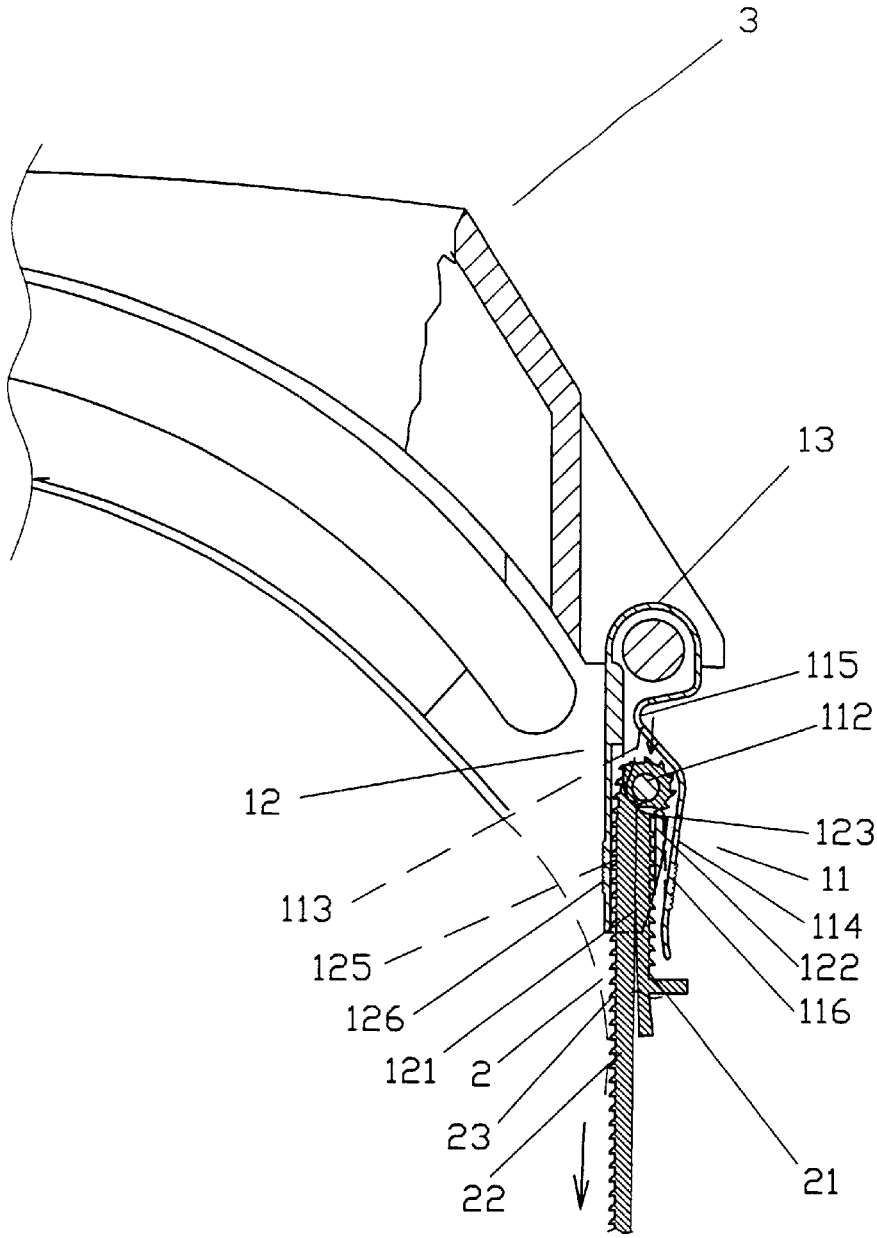
FIG. 5 is a view similar to FIG. 4, illustrating release of the head strap after adjustment.

Referring to FIG. 5, when the head strap 2 is released, the inner portion 22 of the head strap 2 exerts a pulling force (see the upper arrow) on the post 112 of the pressing portion 11. Thus, the post 112 moves toward the top wall 122 of the clamping portion 12. Thus, the post 112 and the retaining edge 123 tightly position the head strap 2 and thus fix the tightening length of the head strap 2. The greater the pulling force from the inner portion 22 is, the more reliable positioning' effect for the head strap 2 is obtained. Further, the head-strap 2 may include teeth 23 on an inner side thereof for engaging with the retaining edge 123, thereby further positioning the head strap 2. Further, the pressing section 113 presses against the abutting section 125 of the clamping portion 2 under the action of force. This assures a gap between the post 112 and the retaining edges 123, preventing the head strap 2 from being damaged by excessive clamping force.

Figure 6:
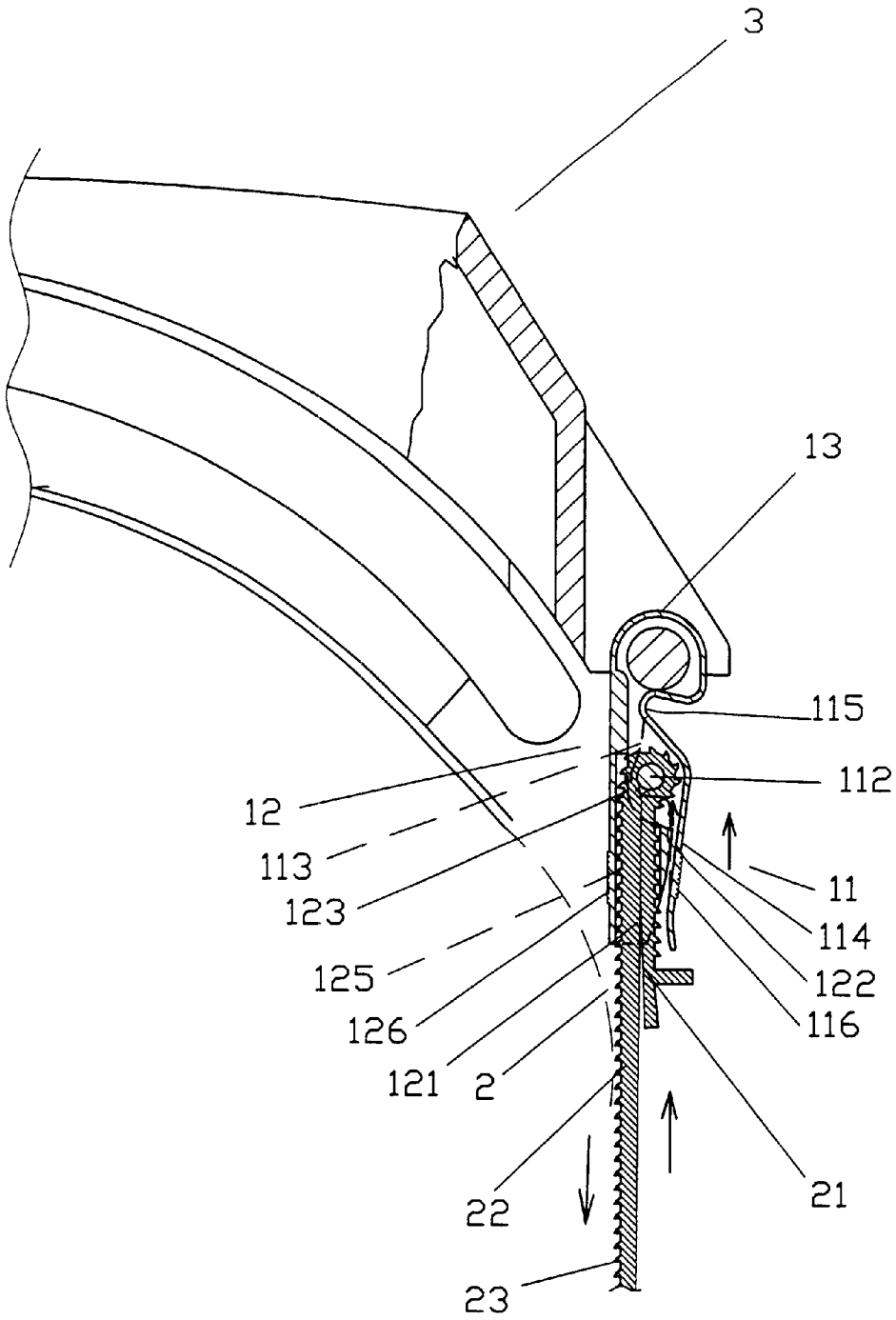
FIG. 6 is a view similar to FIG. 4, illustrating loosening of the head strap by directly moving the head strap.

Referring to FIG. 6, when loosening of the head strap 2 is required, the user can press the anti-slide sections 116 and 126 and push the pressing portion 11 until the post 112 is disengaged from the retaining edge 123. The bending portion 115 assists in easy travel of the release section 114, and the inner portion 22 of the head strap 2 is moved to loosen the head strap 2.

Figure 7:
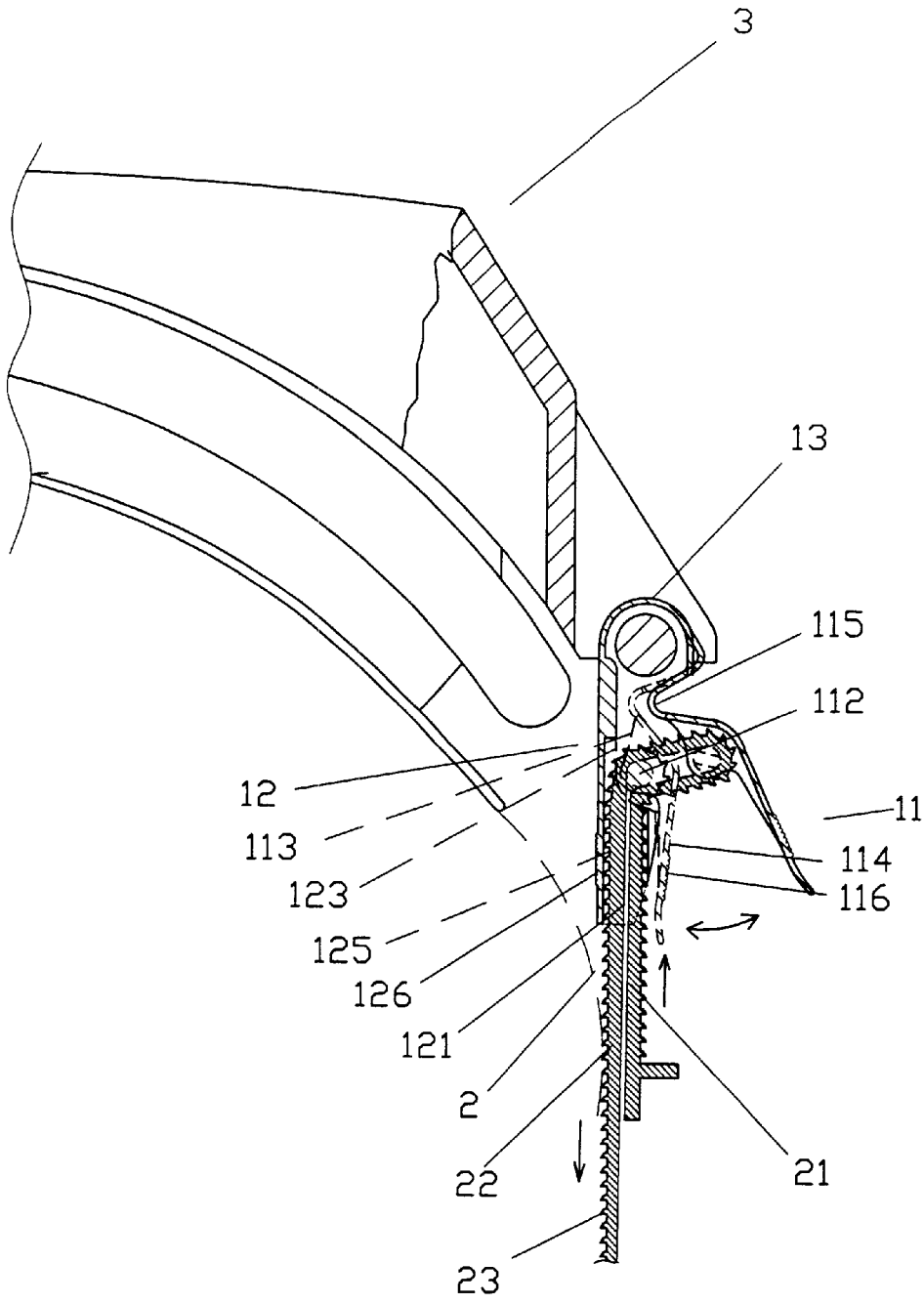
FIG. 7 is a view similar to FIG. 4, illustrating loosening of the head strap through operation of a release section.

Alternatively, referring to FIG. 7, the user can push the release section 114 outward to cause disengagement of the post 112 from the retaining edge 123. Again, the bending portion 115 assists in easy travel of the release section 114, and the inner portion 22 of the head strap 2 is moved to loosen the head strap 2.

Figure 8:
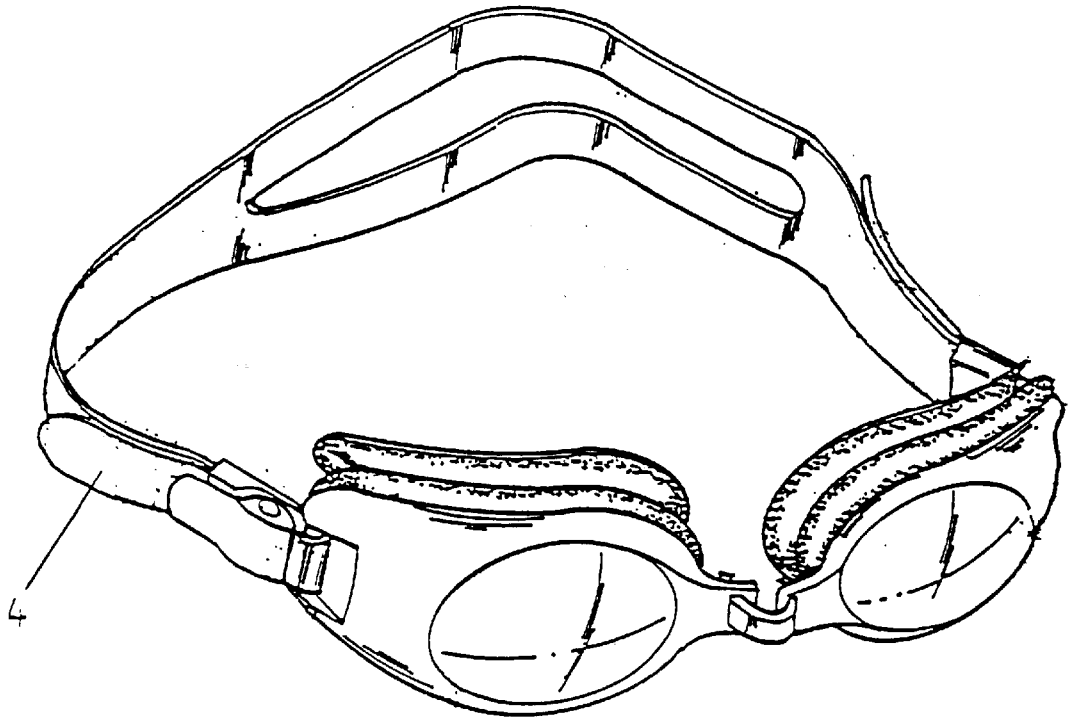
FIG. 8 is an exploded perspective view illustrating use with a head strap of another type.

Referring to FIG. 8, the buckle device in accordance with the present invention can be use with a head strap having two flat sides without teeth.

Figure 9:
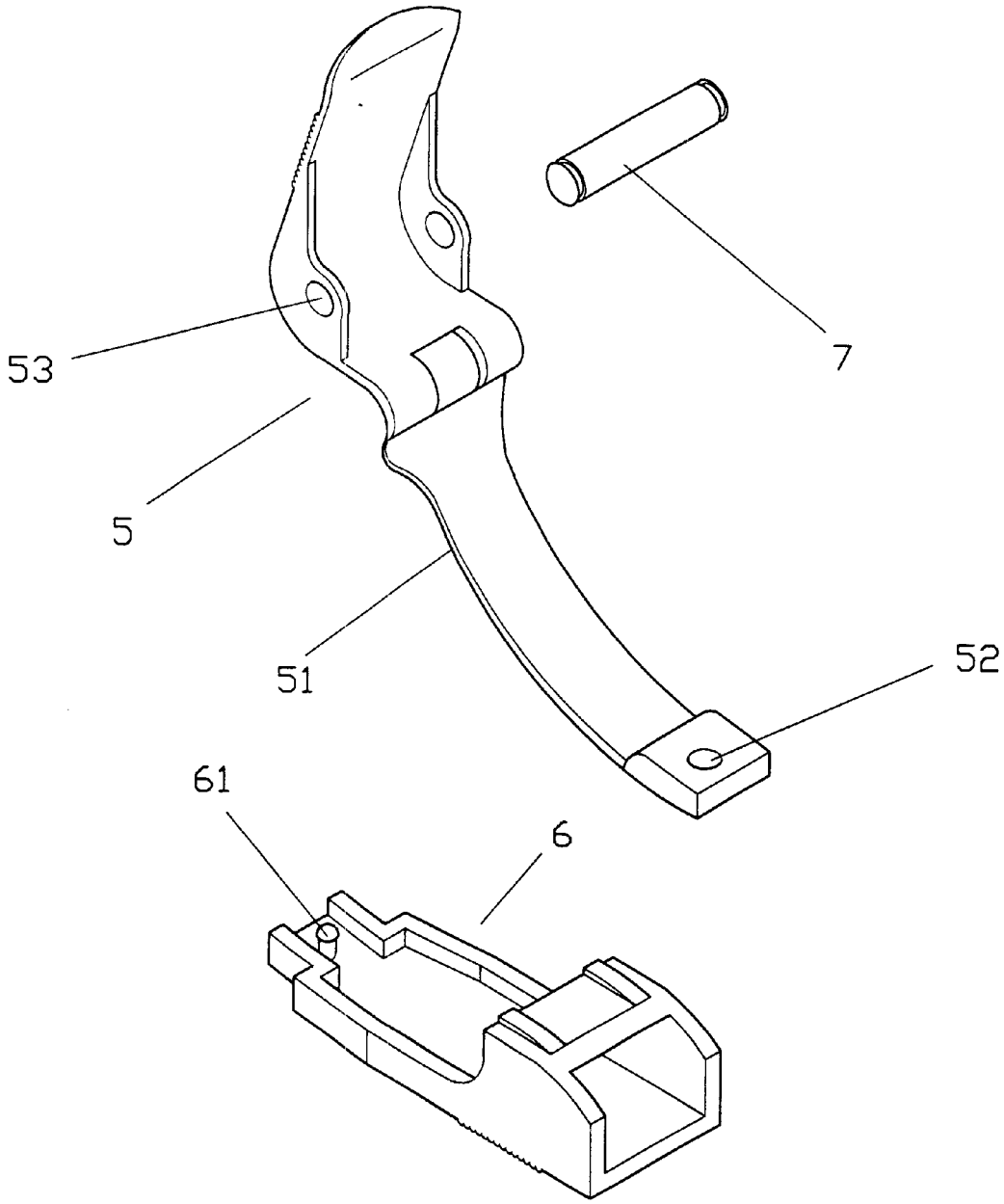
FIG. 9 is an exploded perspective view of another embodiment of the buckle device in accordance with the present invention.
Figure 10:
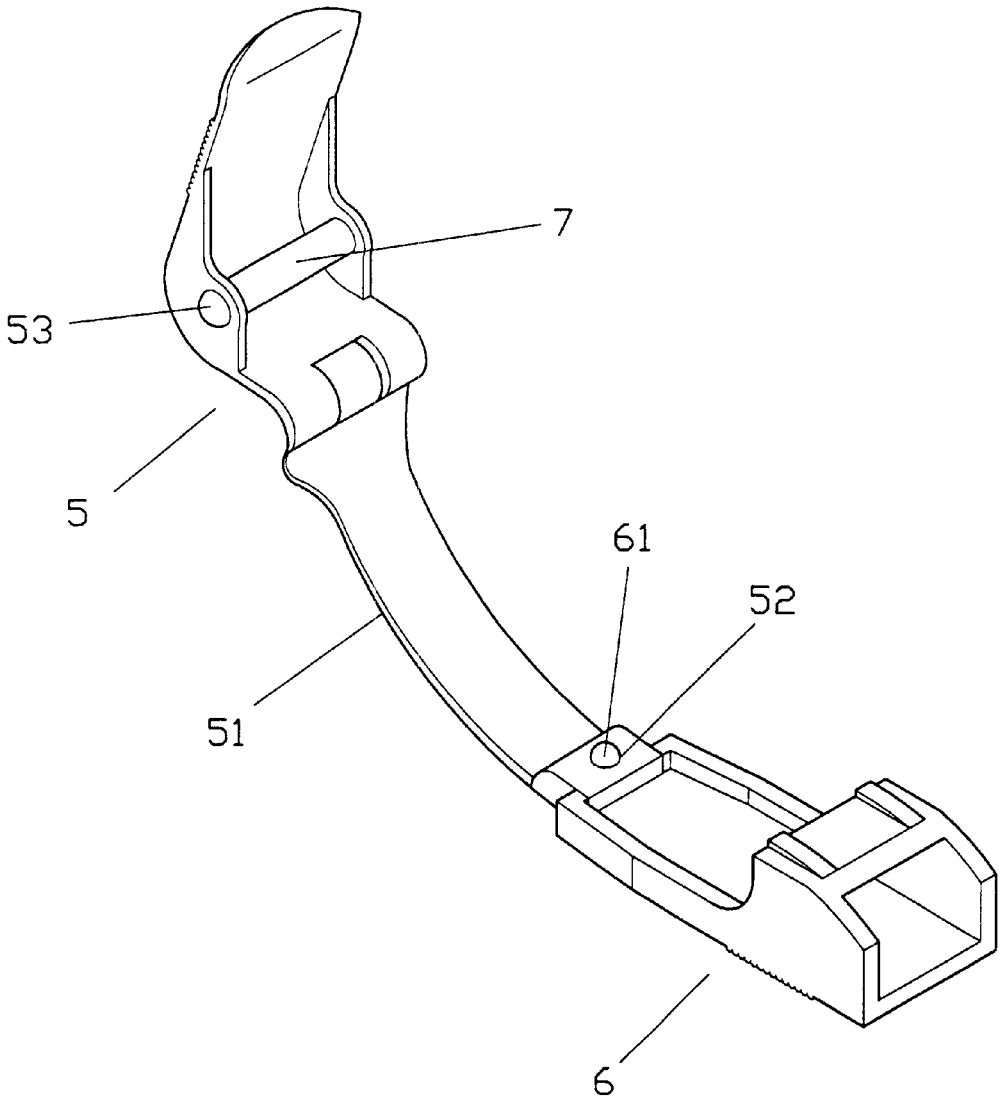
FIG. 10 is a perspective view of the buckle device in FIG. 9.
Figure 11:
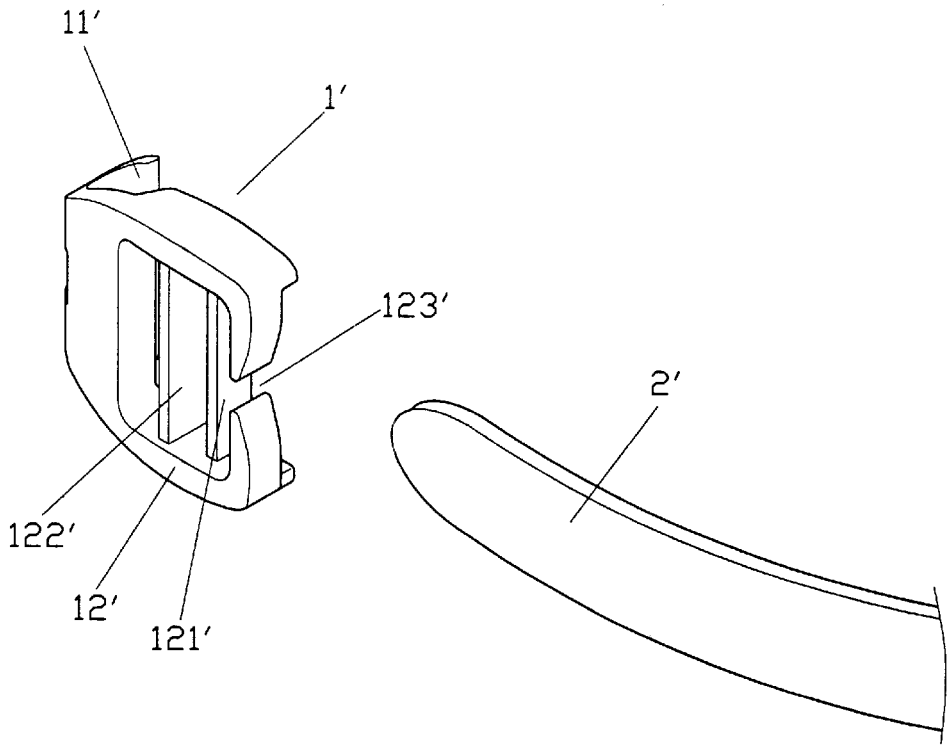
F I G . 11 (PRIOR ART)
FIG. 11 is an exploded perspective view of a conventional buckle for swimming/diving goggles.
Figure 12:
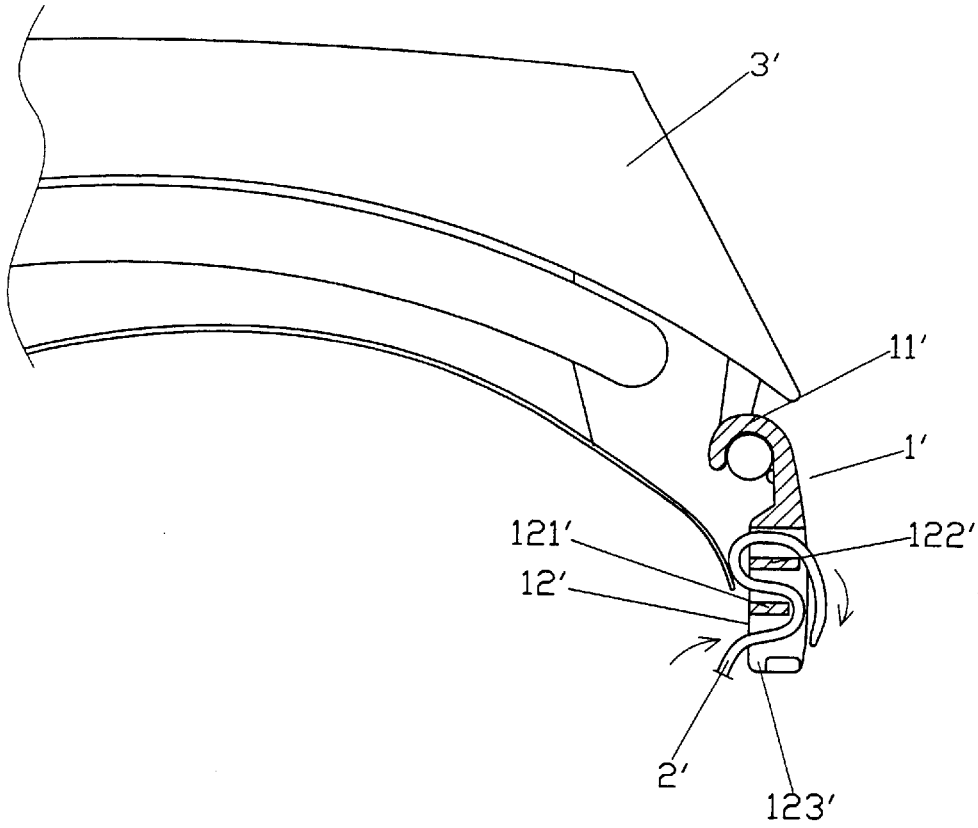
F I G . 12 (PRIOR ART)
FIG. 12 is a partial top view, partly sectioned, of a pair of swimming/diving goggles using the buckle in FIG. 11.
Figure 13:
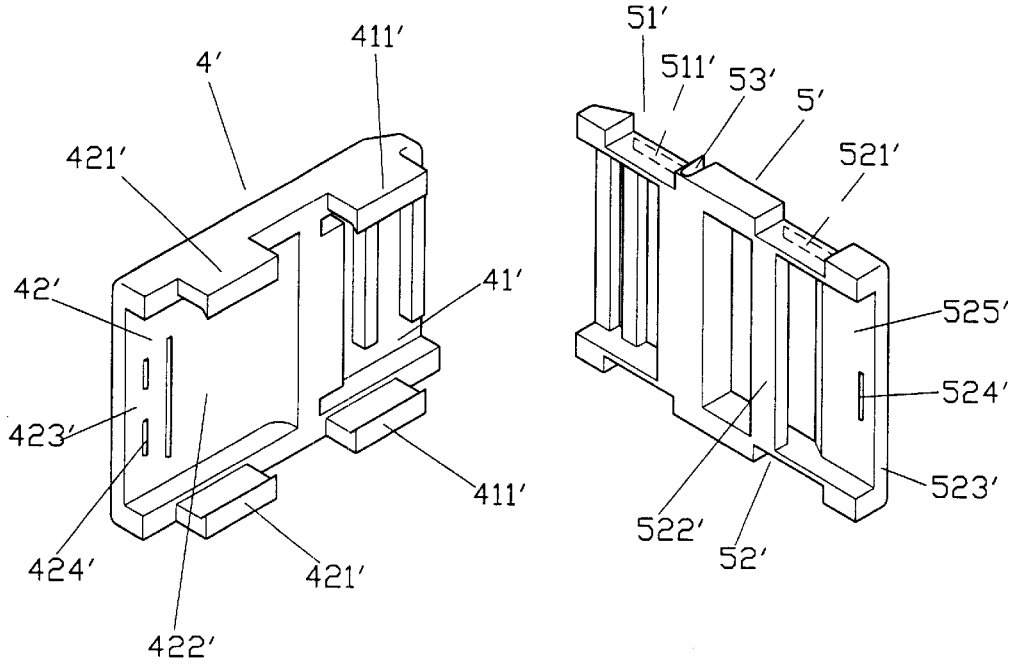
F I G . 13 (PRIOR ART)
FIG. 13 is an exploded perspective view of another conventional buckle.
Figure 14:
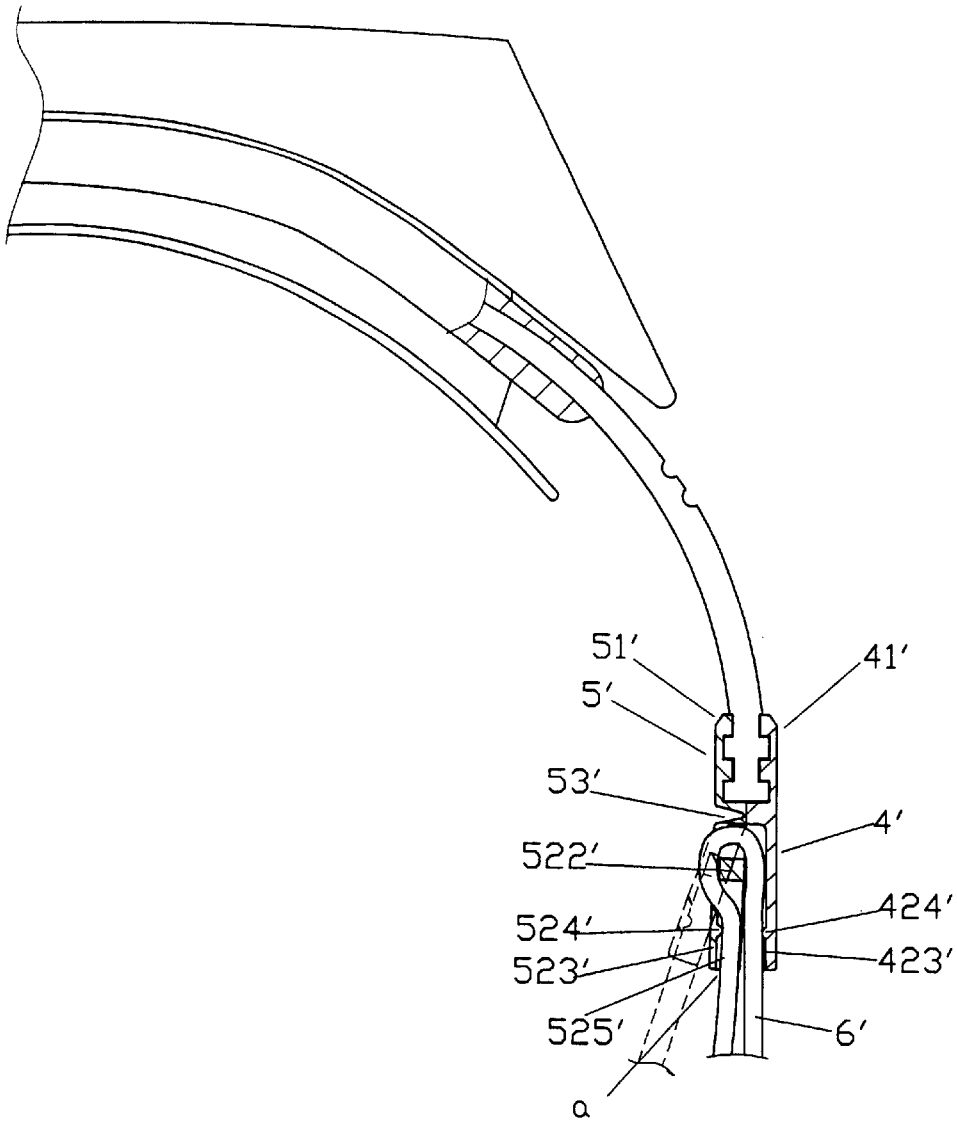
F I G . 14 (PRIOR ART)
FIG. 14 is a partial top view, partly sectioned, of a pair of swimming/diving goggles using the buckle in FIG. 13.
Figure 15:
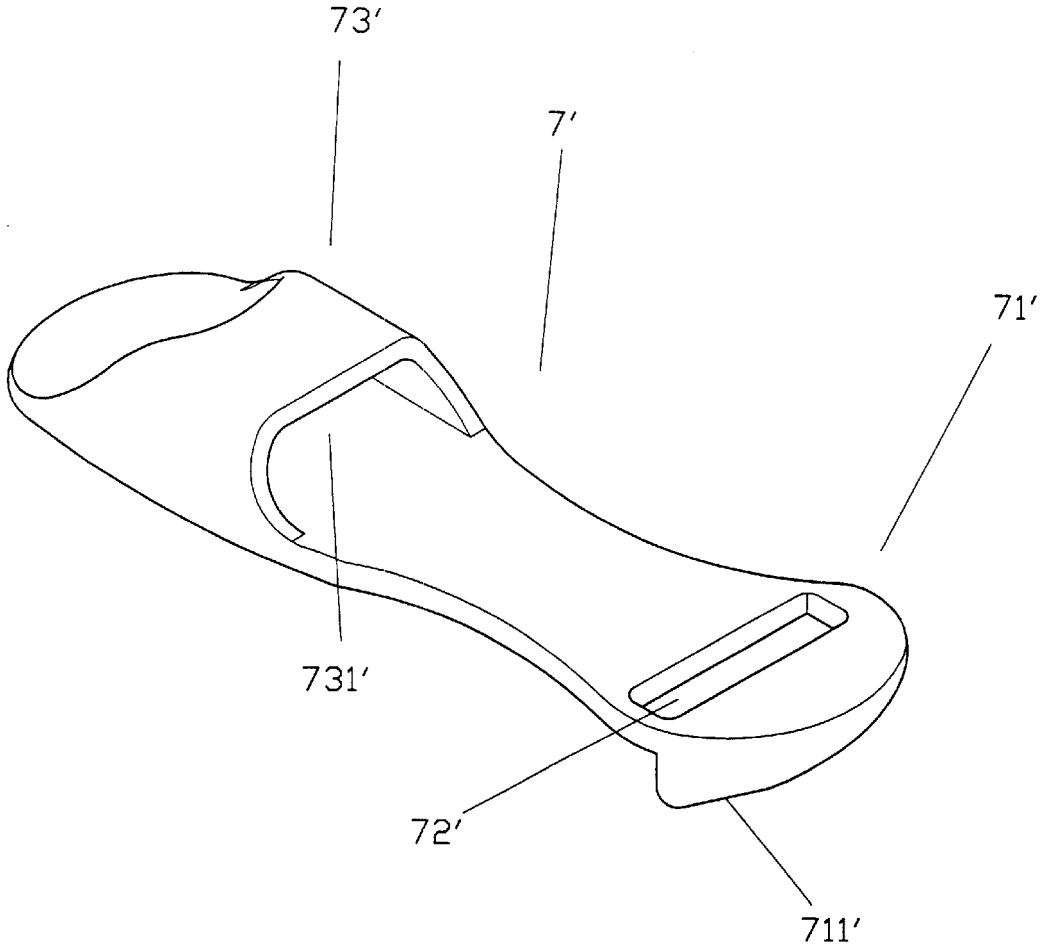
F I G . 15 (PRIOR ART)
FIG. 15 is a perspective view of a further conventional buckle.
Figure 16:
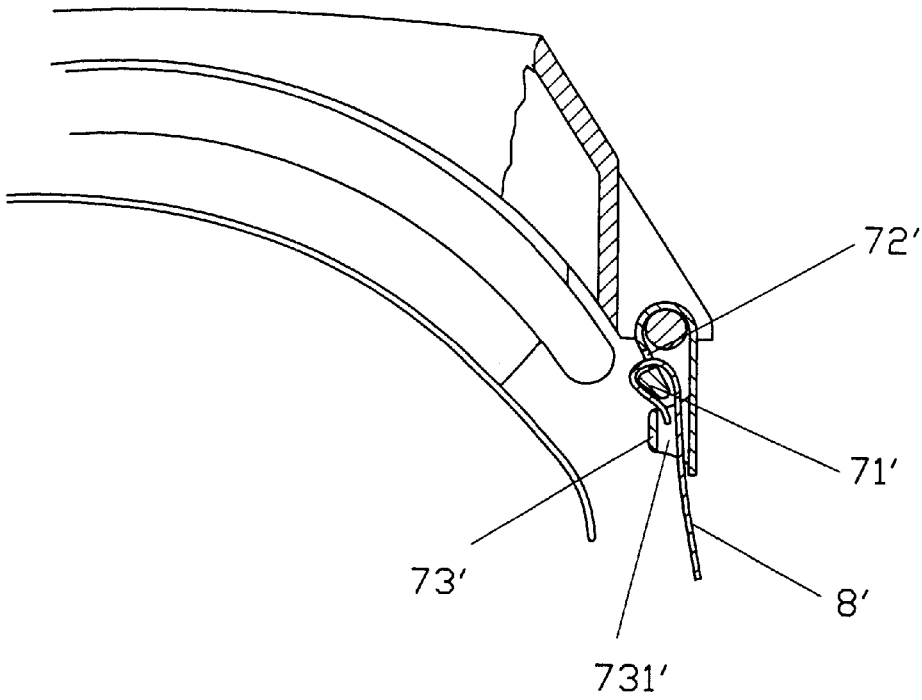
F I G . 16 (PRIOR ART)
FIG. 16 is a partial top view, partly sectioned, of a pair of swimming/diving goggles using the buckle in FIG. 15.
Figure 17:
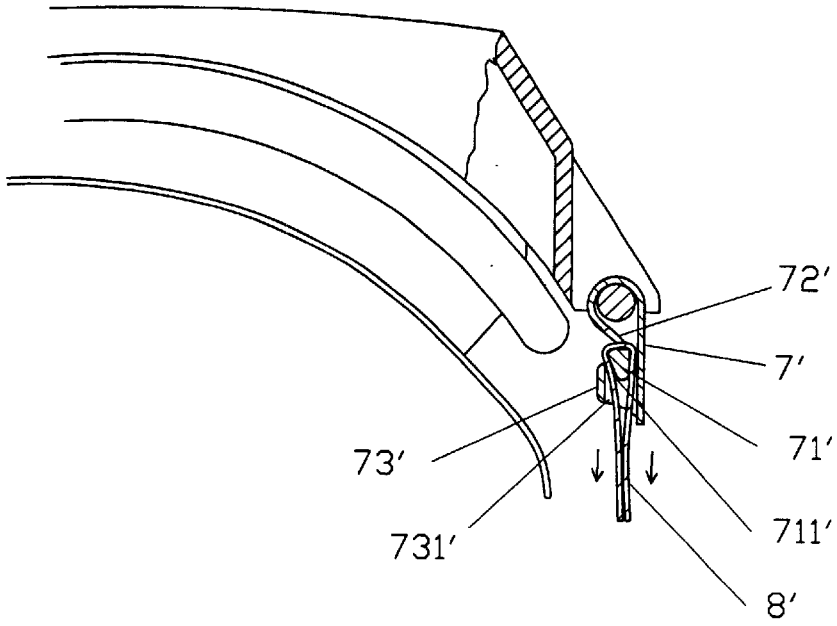
F I G . 17 (PRIOR ART)
FIG. 17 is a view similar to FIG. 16, illustrating adjustment of a head strap of the pair of swimming/diving goggles in FIG. 16.

FIGS. 9 and 10 illustrate a modified embodiment of the invention, wherein the pressing portion (now designated by 5), the clamping portion (now designated by 6), and the post (now designated by 7) can be separately formed. The pressing portion 5 is preferably made of a more flexible material. A connecting portion 51 is attached to an end of the pressing portion 5 and has an engaging hole 52 for engaging with a protrusion 61 on the clamping portion 6, thereby connecting the pressing portion 5 to the clamping portion 6. The pressing portion 5 includes two aligned holes 53 in two sides thereof for mounting the post.

The buckle device in accordance with the present invention allows the user to easily adjust the head strap 2 while wearing the pair of swimming/diving goggles on his/her head. Nevertheless, adjustment of the head strap 2 can be proceeded after the pair of swimming/diving goggles is removed from the head of the user.

Although the invention has been explained in relation to its preferred embodiments, it is to be understood that many other possible modifications and variations can be made without departing from the scope of the invention as hereinafter claimed.

What is claimed is:

1. A buckle for a pair of swimming/diving goggles, the buckle comprising:

a body made of a slightly flexible material, the body including a pressing portion on a first end thereof, a clamping portion on a second end thereof, and a bendable connecting portion between the pressing portion and the clamping portion;

the pressing portion including two sidewalls and a post fixed between the sidewalls;

the clamping portion including a clamping hole delimited by a bottom wall, two lateral walls, and a top wall extending portions of the lateral walls, a retaining edge being formed on a top edge of each said lateral wall;

the connecting portion being mounted around a mounting peg of a main body of the pair of swimming/diving goggles, with the clamping portion and the pressing portion lying side by side;

the pair of swimming/diving goggles including a head strap having an end extending into the body via the clamping hole, winding around the post, and extending out of the body via the clamping hole, the end of the head strap being pullable to obtain a desired tightness, exerting a force to the post to press against the retaining edges, thereby reliably positioning the head strap in place; and the pressing portion being manually movable to disengage the post from the retaining edges, allowing loosening of the head strap.

2. The buckle as claimed in claim 1, wherein the clamping portion has an anti-slide section on an outer side thereof, and wherein the pressing portion has another anti-slide section on an outer side thereof.

3. The buckle as claimed in claim 1, wherein the pressing portion further including a release section, when the release section is manually moved outward away from the clamping portion, the post is disengaged from the retaining edges, allowing loosening of the head strap.

4. The buckle as claimed in claim 1, wherein each said sidewall of the pressing portion has a pressing section, and wherein each said lateral wall delimiting the clamping hole has an abutting edge against which an associated one of the pressing section presses, thereby providing a gap between the post and the retaining edges, preventing the head strap from being damaged by excessive clamping force.

5. The buckle as claimed in claim 1, wherein the pressing portion has a bend extending from an end thereof, the bend being located adjacent to the connecting portion.

6. The buckle as claimed in claim 1, wherein the pressing portion, the clamping portion, and the post are separately formed and then assembled together.

7. The buckle as claimed in claim 6, wherein the pressing portion is made of a flexible material and has a connecting portion and an engaging hole, the pressing portion including two aligned holes in two sides thereof for mounting the post, the clamping portion having a protrusion on an end thereof for engaging with the engaging hole of the pressing portion.

* * * * *